US005361843A

United States Patent [19]

Shy et al.

[11] Patent Number: 5,361,843

[45] Date of Patent: Nov. 8, 1994

[54] DEDICATED PERFORATABLE NIPPLE WITH INTEGRAL ISOLATION SLEEVE

[75] Inventors: Perry C. Shy, Arlington; Christopher A. Dines, Dallas, both of Tex.

[73] Assignee: Halliburton Company, Houston, Tex.

[21] Appl. No.: 950,456

[22] Filed: Sep. 24, 1992

[51] Int. Cl.[5] ..... E21B 43/116

[52] U.S. Cl. ..... 166/297; 166/55.1; 166/242; 166/332

[58] Field of Search ..... 166/297, 55.1, 242, 166/318, 332, 285

[56] References Cited

U.S. PATENT DOCUMENTS

| | | | |
|---|---|---|---|
| 3,057,295 | 10/1962 | Christopher | 175/4.6 |
| 3,073,392 | 1/1963 | Dinning et al. | 166/332 |
| 3,465,836 | 9/1969 | Fields | 166/55.1 X |
| 3,542,130 | 11/1970 | Stout | 166/318 |
| 3,583,481 | 6/1971 | Vernotzy | 166/184 |
| 3,669,190 | 6/1972 | Sizer et al. | 166/315 |
| 3,789,923 | 2/1974 | Garrett | 166/55.1 |
| 3,910,349 | 10/1975 | Brown et al. | 166/153 |
| 4,220,206 | 9/1980 | Van Winkle | 166/318 |
| 4,278,131 | 7/1981 | Jani | 166/332 |
| 4,299,287 | 11/1981 | Vann et al. | 166/297 |
| 4,450,912 | 5/1984 | Callihan et al. | 166/289 |
| 4,673,039 | 6/1987 | Mohaupt | 166/281 |
| 4,880,059 | 11/1989 | Brandell et al. | 166/332 |
| 4,915,175 | 4/1990 | Mashaw, Jr. | 166/332 |
| 4,949,788 | 8/1990 | Szarka et al. | 166/285 |
| 5,012,867 | 5/1991 | Kilgore | 166/188 |
| 5,025,861 | 6/1991 | Huber et al. | 166/297 |
| 5,070,943 | 12/1991 | Walker et al. | 166/297 |
| 5,156,213 | 10/1992 | George et al. | 175/4.52 X |

FOREIGN PATENT DOCUMENTS 2240798 8/1991 United Kingdom .

OTHER PUBLICATIONS

"New system speeds multiple zone horizontal completions", Pike, Wm. J., Ocean Industry, Mar., 1992; pp. 42–44.

*Primary Examiner*—Hoang C. Dang

*Attorney, Agent, or Firm*—Tracy W. Druce; Dennis T. Griggs

[57] ABSTRACT

A production nipple is suspended within an uncased bore hole in a slimhole/monobore completion. A deposit of cement is conveyed through the nipple and is spotted in the annulus across the face of the uncased well bore, with the nipple and cement deposit thereafter being perforated by a small diameter perforating gun. The production nipple has a thin walled section which is characterized by reduced resistance to perforation by a shaped explosive charge. The perforating gun is accurately positioned in registration with the dedicated nipple section by an annular locator slot formed on a coupling sub, which is engagable by a resilient latch arm carried by the perforating gun.

1 Claim, 4 Drawing Sheets

DEDICATED PERFORATABLE NIPPLE WITH INTEGRAL ISOLATION SLEEVE

FIELD OF THE INVENTION

This invention relates generally to apparatus for completing downhole wells, and in particular to flow conductors for conveying inflowing formation fluid in water, oil, gas and recovery wells.

BACKGROUND OF THE INVENTION

In the course of completing an oil and/or gas well, it is common practice to run a string of protective casing or liner into the well bore and then to run production tubing inside the casing. The annulus between the liner or casing and the surrounding formation is sealed with a deposit of cement to prevent fluid flow through the external annulus from one formation zone to another. The cement is pumped through a work string suspended within the casing or liner into the annular space between the liner or casing and the surrounding well bore.

If the lining or casing traverses a hydrocarbon-bearing formation, the lining is perforated to create flow apertures through the casing and cement so that the formation fluids can flow into the well. The liner and/or well casing is perforated by a perforating gun which is suspended within the well. Shaped explosive charges carried by the gun blast openings through the metal lining, the cement deposit and the surrounding formation.

DESCRIPTION OF THE PRIOR ART

In some completions, however, the well bore is uncased, and an open face is established across the oil or gas bearing zone. Open bore hole (uncased) arrangements may be utilized, for example, in water wells, test wells and horizontal/deviated well completions.

Some open bore hole (uncased) installations are known as "slimhole" or "monobore" completions in which a protective liner or casing is not installed across the productive zone. In such completions, a small diameter flow conductor is suspended within the uncased bore hole and cement is pumped through the flow conductor into the annulus between the flow conductor and the surrounding earth formation. After cement residue is cleaned from the flow conductor, the flow conductor and the surrounding cement deposit are perforated to admit formation fluid into the well.

OBJECTS OF THE INVENTION

Because of the economies associated with slimhole/monobore completions, there is a continuing interest in improving the flow conductors used in such completions. There is a need for a small diameter production nipple which can be used in vertical as well as deviated uncased well bores, wherein the production nipple can be used to spot an annular deposit of cement across the face of the uncased well bore, with the nipple and protective cement deposit thereafter being perforated reliably by a small diameter perforating gun. There is also a need for a production nipple of the character described which can be closed and reopened in response to changing conditions in the producing zone.

Accordingly, the principal object of the present invention is to provide an improved production nipple for use in slimhole/monobore completions.

A related object of the present invention is to provide a production nipple which can be opened for production or selectively closed for isolating a zone which may be producing an excessive amount of gas or water.

Another object of the present invention is to provide method and apparatus for reliably locating a perforating gun within a production nipple in a slimhole/monobore completion.

A related object of the present invention is to provide an improved production nipple having a reduced resistance to perforation by a shaped explosive charge.

Still another object of the present invention is to provide a production nipple for use in a slimhole/monobore completion in which improved puncture of the nipple sidewall and penetration into the formation are realized.

SUMMARY OF THE INVENTION

The foregoing objects are achieved according to the present invention by a production nipple which is designed for suspension from a flow conductor within an uncased well bore. The production nipple includes a tubular mandrel having a longitudinal production bore. The tubular mandrel includes first and second longitudinally spaced sidewall sections, with one of the sidewall sections being dedicated for perforation by a perforating gun. The dedicated sidewall section is characterized by a lower resistance to perforation by a shaped charge as compared to the perforation resistance of the other sidewall section. Preferably, the tubular mandrel is intersected by a longitudinal counterbore along the dedicated sidewall section of the mandrel, with the radial thickness of the dedicated sidewall section being less than the radial thickness of the production bore mandrel section. An isolation sleeve is received in slidable, sealing engagement against the production bore of the nipple mandrel, and is shiftable from a first position in which the dedicated sidewall section is covered by the isolation sleeve to a second position in which the dedicated sidewall section is uncovered.

In the preferred embodiment, the nipple is suspended within the well bore on a tubular coupling sub. The coupling sub is radially intersected by an internal, annular locator slot. A resilient latch arm carried on a perforating gun is movable from a retracted, non-interfering position to a radially extended, latched position in which the latch arm is received within the locator slot. According to this arrangement, the perforating gun is located precisely in shoot alignment with the dedicated sidewall section of the production nipple. Because of the reduced radial thickness of the dedicated sidewall section, reliable puncture and penetration through the nipple, cement deposit and earth formation can be obtained with a smaller, less powerful explosive charge.

Other features and advantages of the present invention will be appreciated by those skilled in the art upon reading the detailed description which follows with reference to the attached drawings.

DETAILED DESCRIPTION OF THE PREFERRED EMBODIMENT

Figure 1:
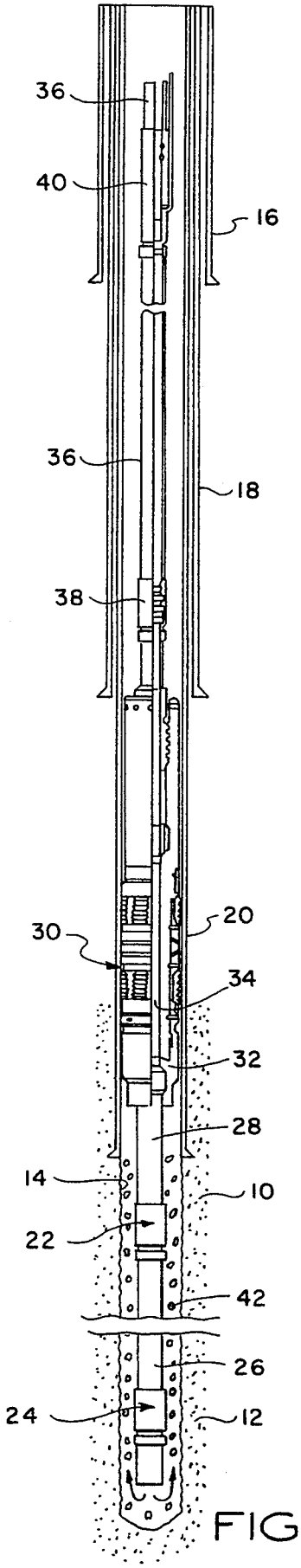
FIG. 1 is a simplified schematic diagram showing a vertical section through two producing formations which are intersected by an uncased well bore which has been completed with two production nipples suspended from a retrievable packer.

In the description which follows, like parts are indicated throughout the specification and drawings with the same reference numerals, respectively. The drawings are not necessarily to scale and the proportions of certain parts have been exaggerated to better illustrate details of the invention.

Referring now to FIG. 1, a first hydrocarbon formation 10 and a second hydrocarbon formation 12 are intersected by an uncased well bore 14. The uncased well bore 14 is sealed from the surface by a primary casing string 16, having an 11 inch diameter, which is secured to the wellhead assembly. Intermediate zones of the uncased well bore 14 are isolated by an intermediate casing string 18, having a 7⅝ inch diameter, and a final casing string 20, having a 5½ inch casing diameter.

The well 14 is completed by multiple nipple sections 22, 24 which are connected by a threaded union T in flow communication by flow conductors 26, 28. The flow conductor 28 is suspended from a retrievable packer 30 which is releasably set in engagement against the bore of the lowermost casing 20. The retrievable production packer 30 includes a mandrel 32 having a longitudinal production bore 34 for conveying formation fluid to the surface. The packer mandrel bore is coupled in fluid communication with a string of 3½ inch production tubing 36 by a full bore landing nipple 38. Production flow through the production tubing string 36 is controlled by a tubing retrievable safety valve 40.

Before the production tubing 36 is installed in the full bore landing nipple 38, a work string is coupled to the landing nipple and a predetermined volume of cement is pumped through the packer bore, the flow conductors 26, 28 and the production nipples 22, 24. The annulus surrounding the suspended flow conductors and production nipples is filled with a cement deposit 42 which prevents vertical flow of formation fluid between the hydrocarbon formation 10 and the hydrocarbon formation 12. A seal plug is introduced into the bore of the work string to separate the cement from the displacing fluid and to wipe the cement from the packer bore, the flow conductor bores and the nipple bores as the cement is displaced out of the tubing and into the surrounding annular space.

After the seal plug has been removed and the production bores have been cleared of debris, a perforating gun 44 is positioned within the bore of each nipple. The perforating gun 44 is suspended and run into the well on a tubing string. Preferably, the tubing string is a length of coil tubing having a firing line inside. The perforating gun assembly 44 is equipped with a mandrel 46 which includes an array of explosive, jet-type perforating charges 48. The perforating gun 44 is coupled to the flow conductor 28 by a locator sub 50.

Upon detonation, each explosive charge 48 produces a high temperature, high pressure plasma jet 52 which penetrates the sidewall of the nipple 22, the protective cement layer 42 and the surrounding formation 12. The high temperature, high pressure plasma jet 52 penetrates the metal sidewall of the nipple, thus producing a clean perforation 54 through the nipple sidewall and an irregular fracture 56 through the surrounding concrete layer and earth formation. Preferably, the shoot is performed with the well in an underbalanced pressure condition relative to the surrounding formation. With a sufficiently high pressure differential, the pressure surge from the surrounding formation will break up any compacted material and sweep it back in the well bore where it will be flowed to the surface. As compacted fragments are swept away, the nipple sidewall perforations 54 are cleaned and cleared for maximum inflow. After the perforating gun 44 is removed from the well, the well is then ready for immediate production.

Figure 3:
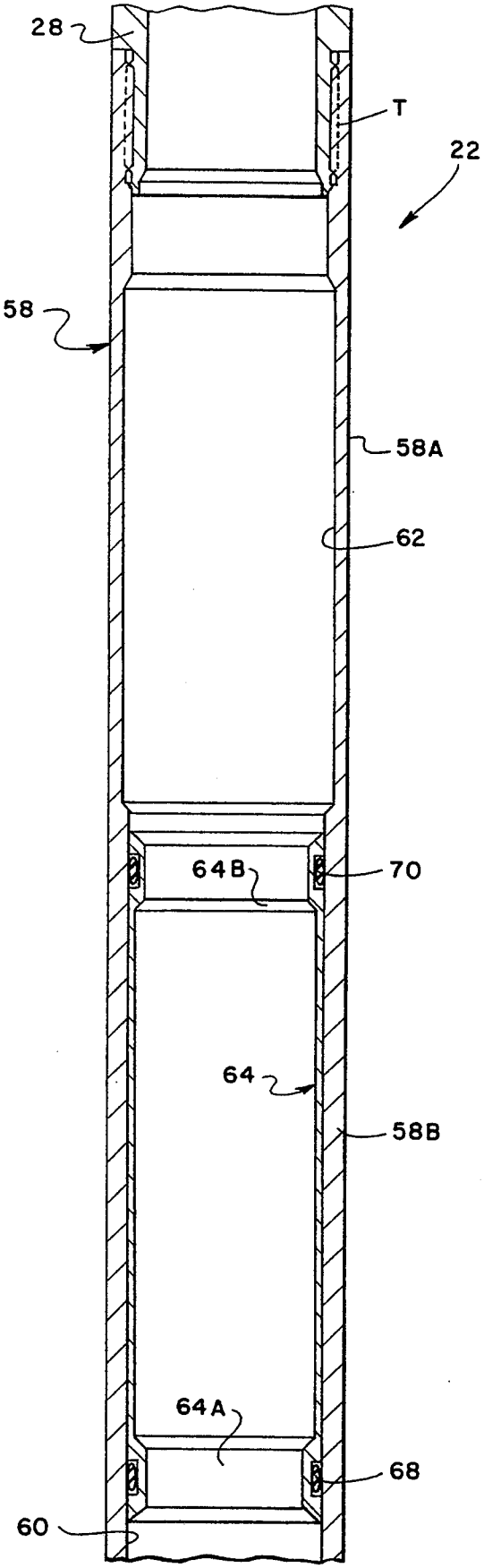
FIG. 3 is a longitudinal sectional view of the production nipple of FIG. 1 showing the isolation sleeve in its uncovered position with the dedicated section of the production nipple being exposed for perforation.
Figure 4:
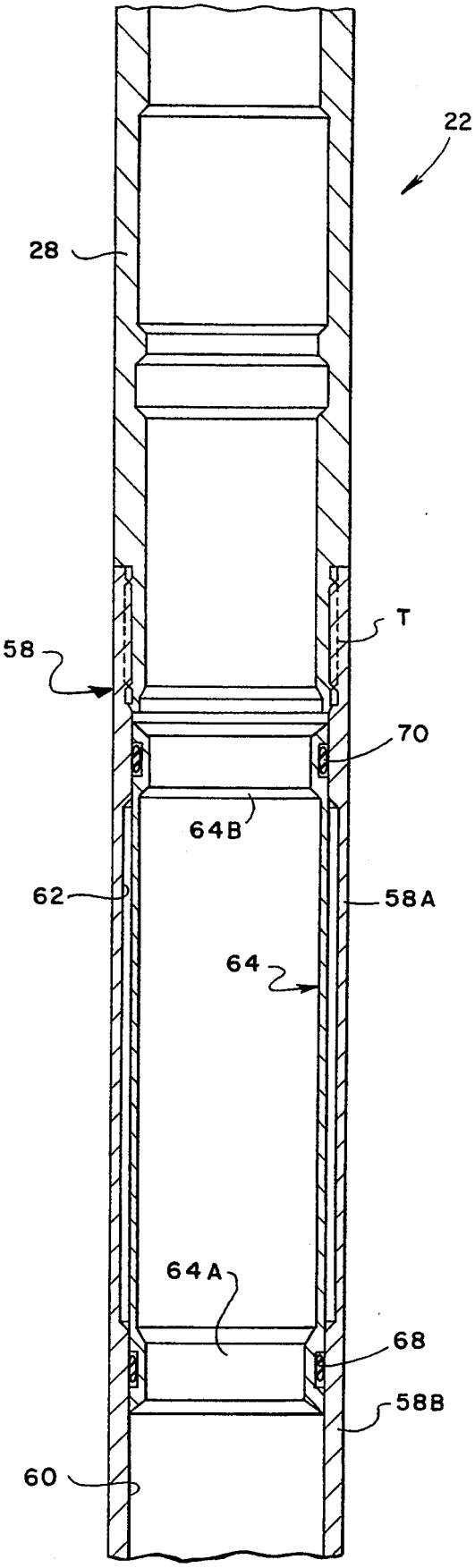
FIG. 4 is a view similar to FIG. 3 in which the isolation sleeve is in its covered position in which the dedicated sidewall of the production nipple is sealed.

Referring now to FIG. 3 and FIG. 4, the production nipple 22 includes a tubular mandrel 58 which includes first and second longitudinally spaced sidewall sections 58A, 58B. According to one aspect of the present invention, one of the mandrel sidewall sections, in this instance section 58A, is dedicated for perforation by a perforating gun, and is characterized by a lower resistance to perforation in response to the explosive force of a shaped charge as compared to the perforation resistance of the other sidewall section 58B. The differential resistance to perforation is obtained, according to one aspect of the present invention, by forming the dedicated sidewall section 58A with a reduced radial thickness as compared to the sidewall thickness of the nipple section 58B.

The mandrel section 58B is intersected by a longitudinal production bore 60, and the dedicated sidewall section 58A is intersected by a longitudinal counterbore 62 which extends along the length of the dedicated sidewall section 58A. According to this arrangement, the main production bore 60 is enlarged by the counterbore 62 along the length of the dedicated sidewall section. The radial thickness of the dedicated sidewall section 58A is reduced substantially with respect to the thickness of the nipple sidewall section 58B, as shown in FIG. 4. In those installations where the nipples support very little hang weight, the radial thickness of the dedicated sidewall section 58A can be reduced substantially relative to the thickness of the nipple sidewall section 58B.

Figure 2:
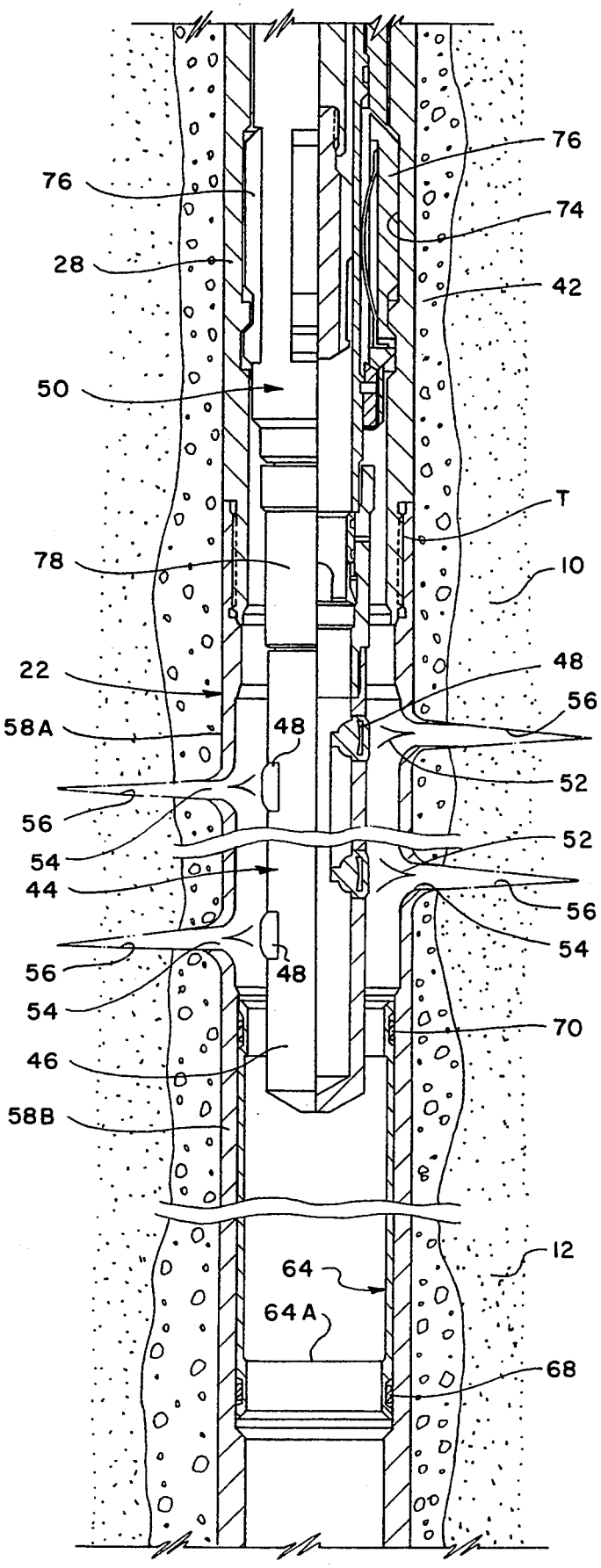
FIG. 2 is a simplified, sectional view which illustrates perforation of the production nipple, cement deposit and formation in a slimhole/monobore completion.

According to another aspect of the present invention, an isolation sleeve 64 is incorporated within the production nipple 22 for the purpose of selectively isolating a particular production zone at any time during the life of the well. That is, the isolation sleeve 64 is shifted to a non-interfering position, as shown in FIG. 2, in which the dedicated sidewall section 58A is exposed to the perforating gun 44. The isolation sleeve 64 is also movable to a closed position, as shown in FIG. 4, in which the perforated, dedicated sidewall section is sealed for the purpose of isolating the zone which may be producing an excessive amount of gas or water.

The isolation sleeve 64 is received in slidable, sealing engagement against the production bore 60 of the nipple mandrel. The isolation sleeve 64 is provided with shifting shoulders 64A, 64B which are engagable by a shifting tool supported on a wire line or by a coiled tubing string. Although the exemplary embodiment shows that the dedicated nipple sidewall section 58A is arranged for exposure by downshifting the isolation sleeve 64, it will be appreciated that the respective positions of the dedicated nipple section 58A and nipple section 58B could be reversed, with the isolation sleeve 64 being shifted upwardly for exposure of the dedicated sidewall section.

As can best be seen in FIG. 4, the isolation sleeve 64 spans the complete length of the dedicated sidewall section 58A, with the counterbore 62 being sealed with respect to the production bore 60 by first and second annular seal members 68, 70, respectively. The annular seal members 68, 70 are curved, molded seals which are carried in annular slots formed in the shifting shoulders 66A, 66B, respectively.

Figure 5:
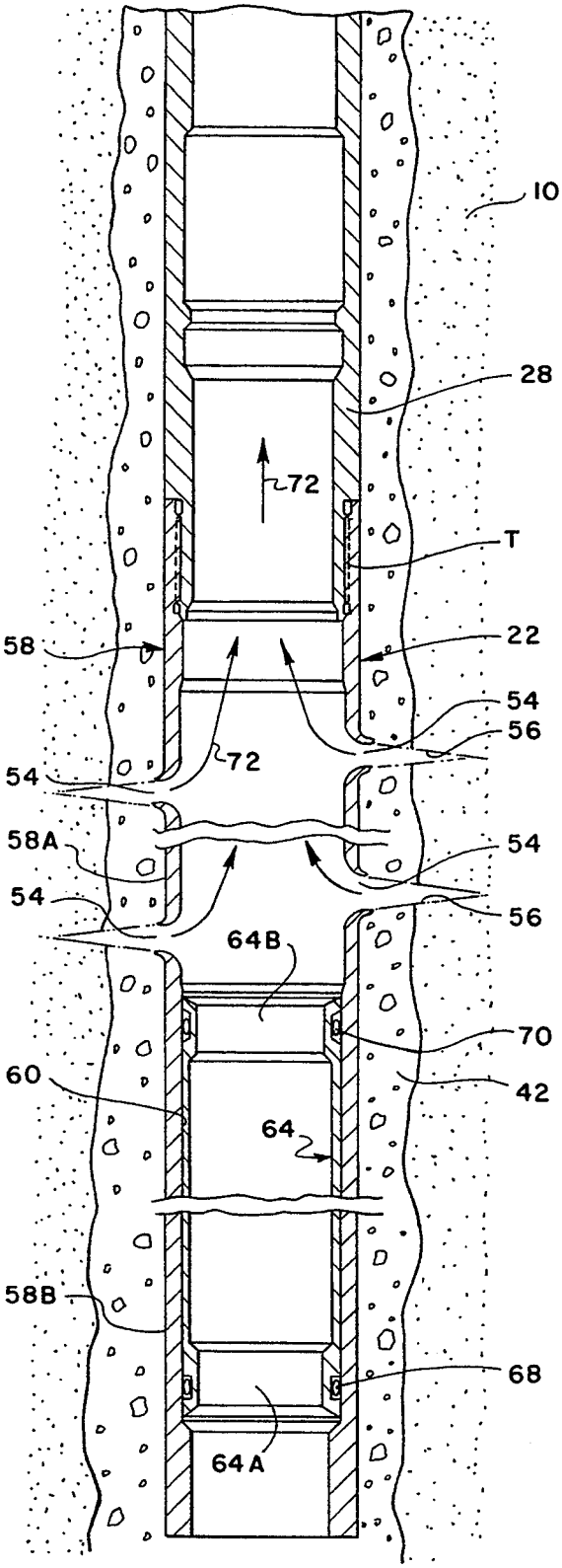
FIG. 5 is a longitudinal sectional view of the slimhole/monobore completion showing the production of formation fluid through the perforated nipple.
Figure 6:
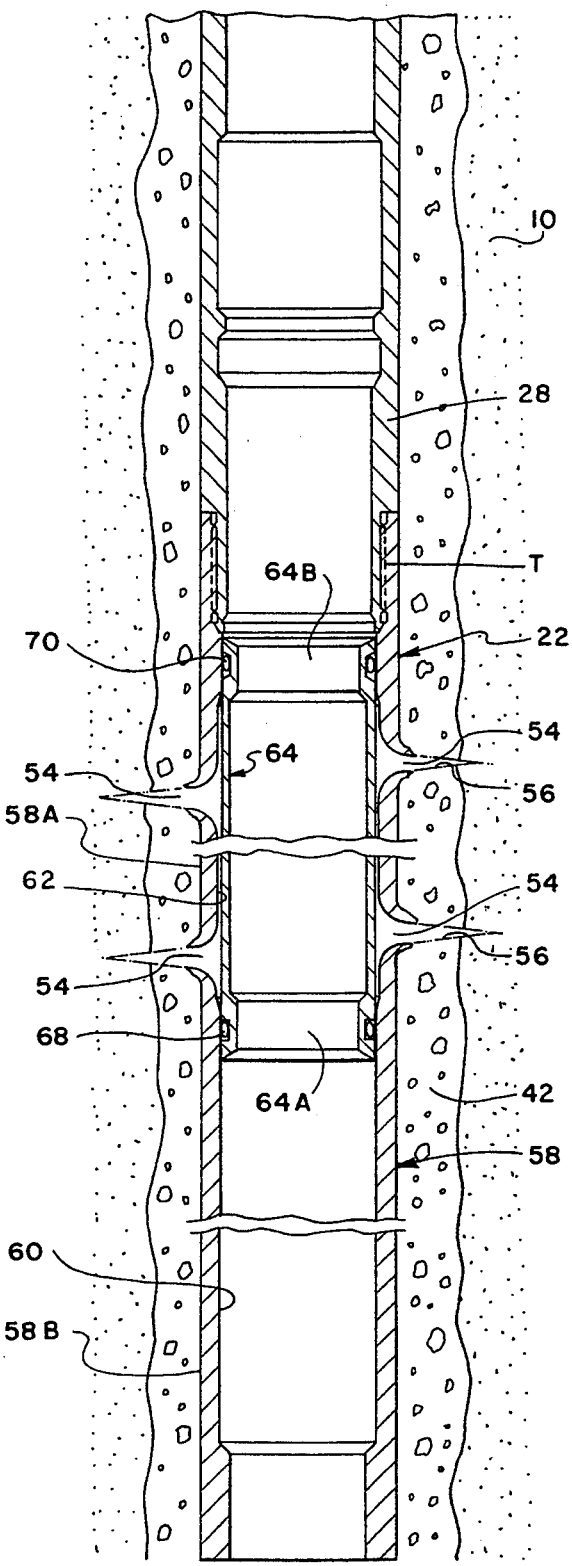
FIG. 6 is a view similar to FIG. 3 in which fluid flow through the production nipple has been terminated by an isolation sleeve; and, FIG. 7 is a simplified, sectional view which illustrates a horizontal well completion in an uncased bore hole in which multiple production nipples are positioned in registration with multiple producing zones.

Referring to FIG. 5, the isolation sleeve 64 is received within the production bore 60 of the nipple mandrel 58 in a non-interfering position in which the dedicated sidewall section 58A of the nipple is uncovered, thus permitting the flow of formation fluid through the nipple perforations 56, as indicated by the arrows 72. As shown in FIG. 6, the dedicated section 58A is completely covered by the isolation sleeve 64, and the counterbore 62 is sealed by the annular seals 68, 70, thus preventing the inflow of formation fluid through the nipple perforations 56.

In some installations, the flow conductor 28 is suspended directly from the wellhead, with one or more production nipples 22, 24 being suspended within an uncased well bore, typically in a shallow slimhole/-monobore well completion. In such installations, the perforating gun 44 may be located accurately when the depth of the production nipple is known. The operator runs the perforating tool until the length of the coiled tubing corresponds with the known depth of the production nipple. However, that method becomes less accurate for deep wells, in particular for wells which may have lateral deviations.

Referring now to FIG. 2, accurate positioning of the perforating gun 44 is provided by an annular locator slot 74 formed on the flow conductor 28, and a resilient, deflectable latch arm 76 carried on the locator sub 50. The resilient, deflectable latch arm 76 is movable from a retracted, noninterfering position which permits travel of the perforating gun 44 through the production bore, to a radially extended, latched position, as shown in FIG. 2, in which it is received within the locator slot 74. According to this arrangement, the perforating gun 44 is located precisely in shoot alignment with the dedicated sidewall section 58A of the production nipple 22. The longitudinal distance of the dedicated nipple sidewall section 58A relative to the locator slot 74 is known, and the length of the perforating gun 46 relative to the latch arm 76 is adjusted with a coupling sub 78 so that the explosive charges 48 are centered in shoot alignment along the length of the dedicated nipple sidewall section 58A when the latch arm 76 is received in detented engagement with the locator slot 74.

Figure 7:
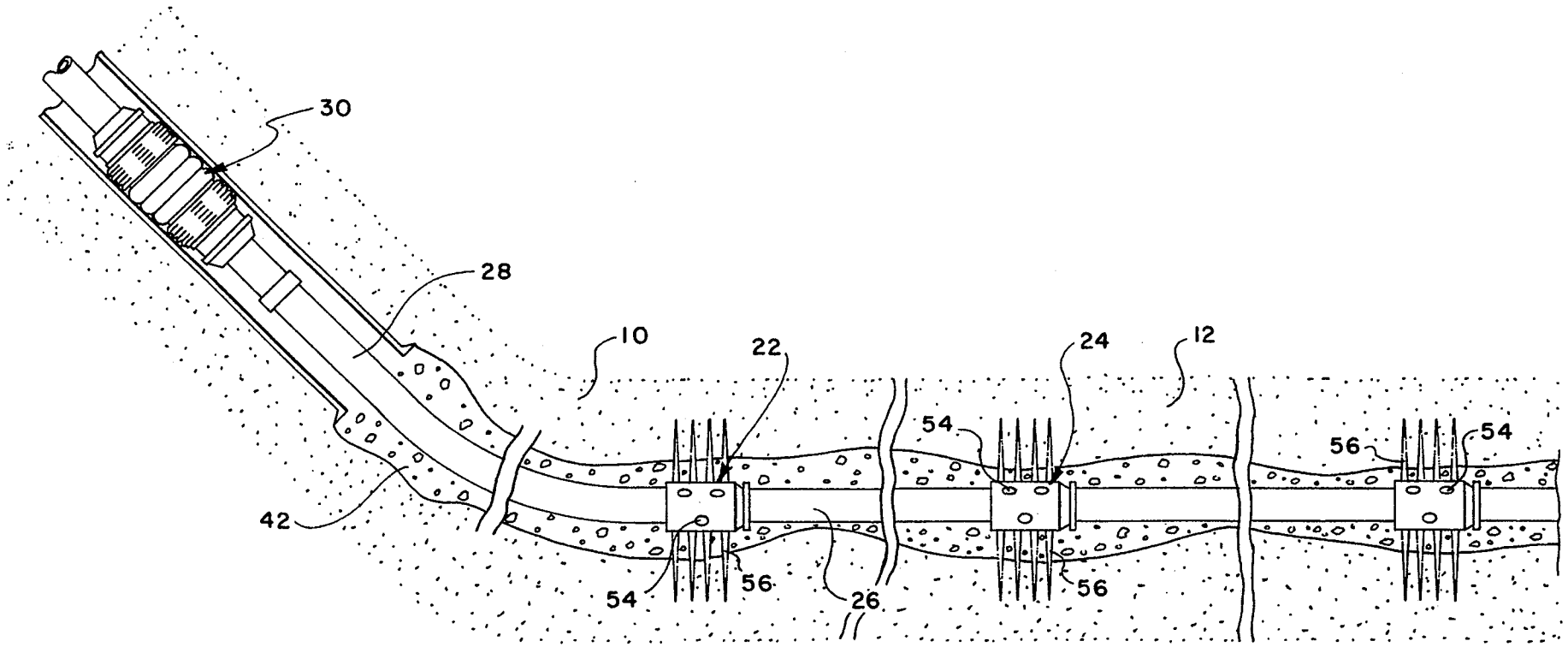

It will be appreciated that because of the reduced radial thickness of the dedicated nipple sidewall section 58A, reliable puncture and penetration through the nipple 22, cement deposit 42 and earth formation 10 can be obtained with a smaller, less powerful explosive charge. Since a less powerful explosive charge is required, the perforating gun 46 can be physically smaller in diameter, and can be run through the small diameter production tubing (3½ inch or smaller) utilized in slimhole/monobore completions. Because of the reduced sizing provided by the production nipple of the present invention, the well may be drilled with a smaller rig, less well control material is required during drilling of the bore hole, the quantity of cement required is reduced, and the size and quantity of casing and tubing required to complete the well are reduced. Moreover, the well may be completed on coiled tubing, thus further reducing the cost of the completion string and reducing the overall time required for installation. Since coiled tubing may be utilized, the well may be completed or recompleted without the necessity of killing the well, thereby reducing the potential for damage to the reservoir. Moreover, in multizone completions, the production nipples may be opened and closed as desired, either sequentially or selectively, for isolating a zone which may be producing too much water or gas. The production nipples of the present invention may also be used in uncased, horizontal completions as shown in FIG. 7.

Although the invention has been described with reference to an oil well completion, and with reference to particular preferred embodiments, the foregoing description is not intended to be construed in a limiting sense. The production nipple of the present invention may be used to good advantage in alternative applications, for example, in gas wells, environmental wells, including monitoring wells, recovery wells and disposal wells. It is therefore contemplated that the appended claims will cover any such applications which incorporate the production nipple of the present invention.

What is claimed is:

1. A method for completing a well comprising:

suspending a flow conductor and a production nipple having a tubular sidewall section within a well casing;

pumping cement into the annulus between the production nipple and the well bore;

removing residual cement from the bore of the production nipple;

perforating the tubular sidewall section of the production nipple and the annular cement deposit with a perforating gun; and, isolating the production nipple by covering the perforated sidewall section with a tubular sleeve.

* * * * *